US006644414B1

(12) United States Patent
Lau

(10) Patent No.: US 6,644,414 B1
(45) Date of Patent: Nov. 11, 2003

(54) LIFE SAVING FIRE EXIT METHOD AND APPARATUS

(76) Inventor: David M. K. Lau, 16 Hop Yat Road 4/F KLN, Hong Kong (HK)

( * ) Notice: Subject to any disclaimer, the term of this patent is extended or adjusted under 35 U.S.C. 154(b) by 0 days.

(21) Appl. No.: 10/128,537

(22) Filed: Apr. 22, 2002

(51) Int. Cl.[7] ..... A62C 2/00

(52) U.S. Cl. ..... 169/43; 169/48; 169/52; 169/54

(58) Field of Search ..... 169/43, 48, 51, 169/52, 54, 64; 182/47, 48, 51, 77, 82

(56) References Cited

U.S. PATENT DOCUMENTS

| | | | | | |
|---|---|---|---|---|---|
| 3,768,593 | A | * | 10/1973 | Naka | 182/77 |
| 3,960,216 | A | * | 6/1976 | Isobe | 169/48 |
| 4,010,822 | A | * | 3/1977 | Banner | 182/47 |
| 4,079,812 | A | * | 3/1978 | Naka | 182/48 |
| 4,315,456 | A | * | 2/1982 | Hayashi et al. | 169/48 |
| 4,469,198 | A | * | 9/1984 | Crump | 182/141 |
| 4,640,384 | A | * | 2/1987 | Kucher et al. | 182/51 |
| 5,188,186 | A | * | 2/1993 | Nash | 169/48 |
| 5,353,879 | A | * | 10/1994 | Watanabe et al. | 169/52 |
| 5,469,920 | A | * | 11/1995 | Conti et al. | 169/48 |

* cited by examiner

*Primary Examiner*—Steven J. Ganey
(74) *Attorney, Agent, or Firm*—William L. Chapin

(57) ABSTRACT

An apparatus for inhibiting wide dispersal of heat, smoke and noxious gases from a fire in a structure such as a building occupied by people, thereby facilitating evacuation of the building through exit routes rendered relatively smoke-free by the apparatus includes a portable enclosure which has an entrance opening hermetically sealable to a doorway opening when the enclosure is moved into position adjacent to the doorway, and encloses an open-top tank which contains water, and a vertical baffle which protrudes downwardly from a roof panel of the enclosure, the baffle being disposed transversely across the enclosure with a lower edge of the baffle immersed beneath the surface of the water to thereby form a water-trap type air-lock. A method of traveling from a smoke-filled region of a building to a smoke-free region comprises stepping into water in the tank through the enclosure entrance opening, ducking the head under the lower edge of the baffle, walking on the tank bottom to the opposite side of the baffle, and exiting the tank through an exit opening in the enclosure. In one embodiment of the apparatus, a solid baffle is replaced by one or more curtains of water which flow downwardly from a manifold disposed transversely under the roof panel of the enclosure, water from the tank being recirculated to the manifold by a pump.

33 Claims, 7 Drawing Sheets

Fig. 8
Fig. 10
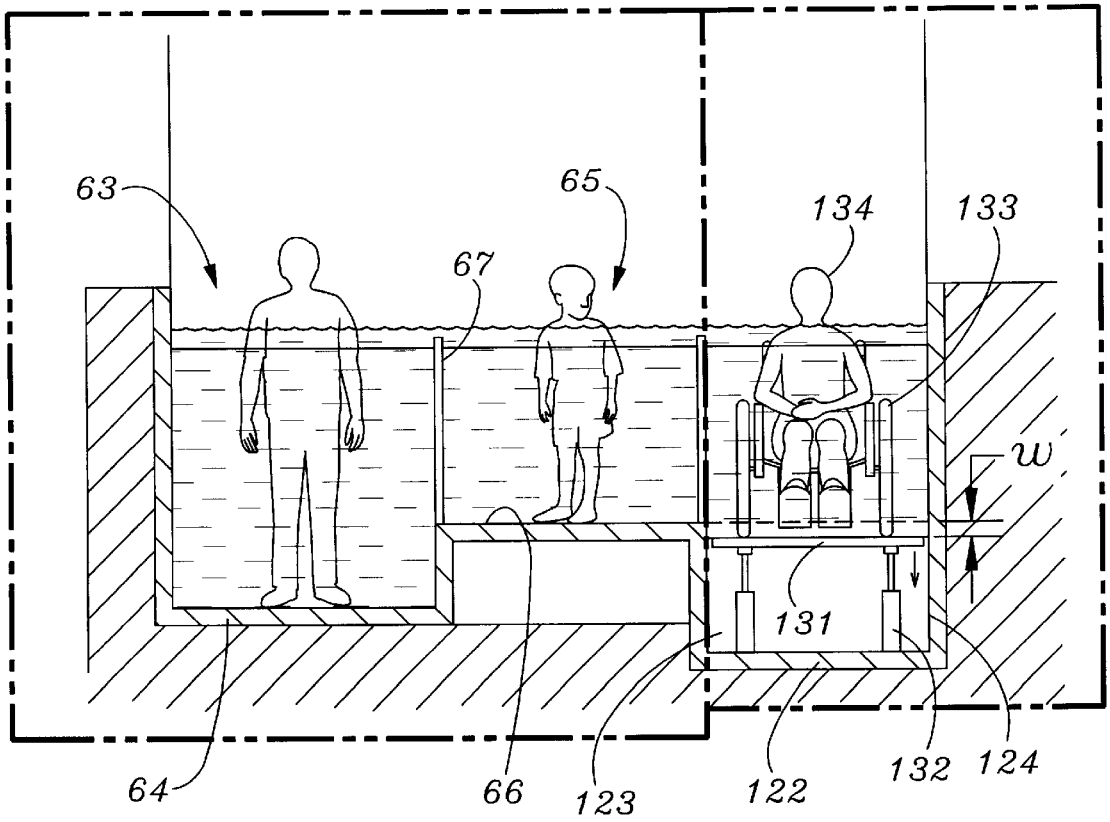
Fig. 9
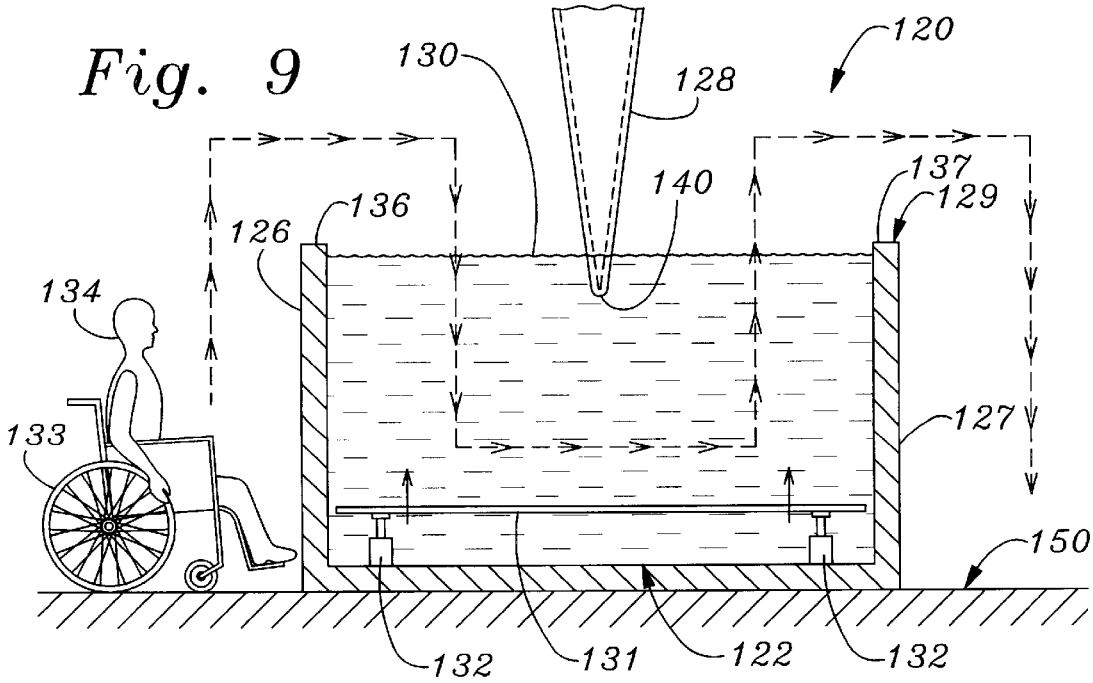

LIFE SAVING FIRE EXIT METHOD AND APPARATUS

BACKGROUND OF THE INVENTION

A. Field of the Invention

The present invention relates to methods and apparatus for facilitating evacuation of people from burning buildings. More particularly, the invention relates to a portable apparatus which is moved into sealing contact with a hallway opening or doorway of a burning building to block heat, smoke and noxious combustion gases produced by a fire located upstream of the opening from passing into areas of the building downstream from the hallway opening, while enabling people to transit safely through the apparatus to exit the building.

B. Description of Background Art

Fires occurring in buildings occupied by people are often initially confined to a relatively small area, enabling occupants to safely escape, provided the building is equipped with suitable alarm systems and evacuation routes. However, even if a building fire is initially confined to a relatively small area, and relatively slow moving, smoke, noxious combustion products and heat produced by the fire can travel relatively quickly from the fire to other parts of the building. Even relatively small amounts of smoke can obscure a person's vision and impede his or her safe evacuation from the building. Of even greater concern is the fact that inhalation of sufficient quantities of smoke, gaseous combustion products, or even hot air can and frequently does result in death. Accordingly, when a fire breaks out in a building, it is desirable to confine products of the fire as well as the fire itself to its area of origin, to facilitate safe evacuation of the building. Therefore, buildings occupied by people are sometimes provided with relatively large and heavy fire doors that are manually or automatically closed when a fire breaks out in a building to inhibit the spread of a fire, and to inhibit heat, smoke, and noxious gases produced by the fire from rapidly diffusing throughout the building. Besides being relatively difficult to open by individuals who do not have great physical strength, fire doors undesirably pose no barrier to heat, smoke, and noxious combustion gases when opened by an individual to exit through the doorway.

The present inventor is aware of two prior art systems which use water to inhibit movement of heat, smoke and hot gases through a tunnel or other occupied structure, thus facilitating safe evacuation of humans from the structure. Thus, Hattori, U.S. Pat. No. 4,077,474, Mar. 7, 1978, Flame And Smoke Shutoff System, discloses a flame and smoke shutoff system which uses a curtain made of flexible, nonflammable material. The curtain drops down from the ceiling to a floor of a building passageway in the event of a fire, and a mixture of water and a bubbling agent is made to flow down the curtain to check the spread of flame and smoke, while allowing individuals to raise the curtain temporarily and step through to escape. Mühlenbruck, in PCT Publication No. WO0180954, published Nov. 1, 2001, discloses a system for facilitating escape from a tunnel which might otherwise be filled with smoke and hot gases, the system utilizing a series of water mist curtains sprayed from the tunnel ceiling.

The present invention was conceived of to provide a life-saving fire exit apparatus and method for use in buildings which provides a positive barrier to smoke and hot gases emanating from a fire in a building, while enabling easy and safe transit of individuals through the barrier to smoke-free regions of the building, thereby facilitating safe evacuation of the building.

OBJECTS OF THE INVENTION

An object of the present invention is to provide a life saving fire exit apparatus for facilitating evacuation of humans from a burning building, the apparatus including a barrier for confining smoke and hot gases to the locality of a fire, while permitting ready egress of individuals through the barrier.

Another object of the invention is to provide a life saving fire exit apparatus for buildings which includes a water trap for smoke and hot gases which permits ready egress through the trap by an individual to evacuate the building.

Another object of the invention is to provide a life saving fire exit apparatus for buildings which includes a water-filled pool, and a wall or baffle which protrudes downwardly from a building ceiling, the baffle having a lower transverse disposed edge below the surface of water in the pool to thereby form with the water a smoke impervious, air-lock type barrier, and entrance and exit steps to the pool which facilitate an individual's stepping into the pool, ducking his or her head into the water beneath the lower edge of the baffle, stepping under the baffle and stepping out of the pool to thereby enter relatively smoke-free areas and safely exit the building.

Another object of the invention is to provide methods for blocking smoke and hot gases emanating from a fire within a building from traveling through a building passageway, while enabling individuals to pass readily through the passageway, the method comprising the steps of positioning a pool of water in an exit passageway of a building, positioning a vertically disposed baffle transversely across the passageway in hermetically sealing contact with water in the pool and adjacent passageway walls, and providing means such as entrance and exit stairways or stepladders for facilitating an individual's entering the pool, ducking his or her head into the water beneath one side of the baffle, moving underneath the baffle, and exiting from the pool on the opposite side of the baffle.

Various other objects and advantages of the present invention, and its most novel features, will become apparent to those skilled in the art by perusing the accompanying specification, drawings and claims.

It is to be understood that although the invention disclosed herein is fully capable of achieving the objects and providing the advantages described, the characteristics of the invention described herein are merely illustrative of the preferred embodiments. Accordingly, I do not intend that the scope of my exclusive rights and privileges in the invention be limited to details of the embodiments described. I do intend that equivalents, adaptations and modifications of the invention reasonably inferable from the description contained herein be included within the scope of the invention as defined by the appended claims.

SUMMARY OF THE INVENTION

Briefly stated, the present invention comprehends a life saving fire exit apparatus and method which facilitates the safe evacuation of a building in which a fire producing heat, smoke and noxious gases has broken out.

A life saving fire exit apparatus according to the present invention includes a portable enclosure which contains shallow, generally rectangularly shaped open-top tank similar to a wading pool or spa, which contains water, and a vertically oriented baffle disposed transversely across the width of the tank which has a lower edge immersed beneath the surface of water in the tank, the baffle extending to the ceiling of the enclosure. The baffle spans the width of the enclosure, and is in air-tight contact with the side walls and ceiling thereof. Also, the enclosure includes an entrance opening hermetically sealable to a building passageway opening such as a hallway opening, when the enclosure is moved into position adjacent to the opening. The enclosure contains a short entrance stairway located on an entrance side of the pool, and a short exit stairway located at the opposite side of the pool, on the other side of the baffle.

The enclosure has a peripheral seal around the entrance opening thereof, which, when positioned in hermetically sealing contact with a hallway opening, cooperates with water in the tank and the baffle immersed in the water to form an air-lock type barrier which blocks the passage of smoke and noxious gases through the hallway opening. As is explained below, the barrier is not breached by an individual transiting through the barrier.

In a main embodiment of the life saving fire exit apparatus according to the present invention, the vertically disposed baffle has the form of a V-shaped trough or channel made of a rigid material such as a stainless steel plate bent at an acute angle to form a pair of side panels, the lower vertex portion of which contains water maintained at the same level as that in the pool. A pair of longitudinally aligned, fire-proof windows, one in each of the side panels of the baffle, enable individuals on either side of the baffle to visually assess conditions on the other side thereof. In an alternate embodiment of the apparatus, the solid baffle is replaced by one or more curtains of water flowing from one or more manifolds disposed transversely beneath the ceiling of the enclosure, water being pumped up to the manifold from a step-through holding tank and flowing back into the tank in a closed loop, re-circulating system. In that embodiment, the water level in the tank can be substantially lower than that of the solid baffle embodiment, thus, the tank can be much shallower, and not require entrance or exit steps.

According to another aspect of the invention, a method of inhibiting wide dispersal of smoke and noxious gases from a fire in a building, while enabling people to evacuate the building comprises positioning a pool of water within a passageway within the building, positioning a baffle in hermetically sealing contact with side walls and ceiling of the passageway, the baffle being disposed vertically downwards from the ceiling with the lower edge of the baffle immersed beneath the surface of water in the pool, and providing an access path through the pool which enables an individual to readily step into the pool, duck his or her head into the water beneath the lower edge of the baffle, walk through the water underneath the baffle, and step out of the pool to a smoke-free evacuation route from the building.

BRIEF DESCRIPTION OF THE DRAWINGS

FIG. 8 is a sectional view of the device of FIGS. 6 and 7, showing an adult and child emerging through the device.

FIG. 9 is a diagrammatic view of a modification of the device of FIG. 1 suitable for use by a person in a wheel chair.

FIG. 10 is a transverse sectional view showing a person in a wheel chair using the device of FIG. 9.

DESCRIPTION OF THE PREFERRED EMBODIMENTS

Figure 1:
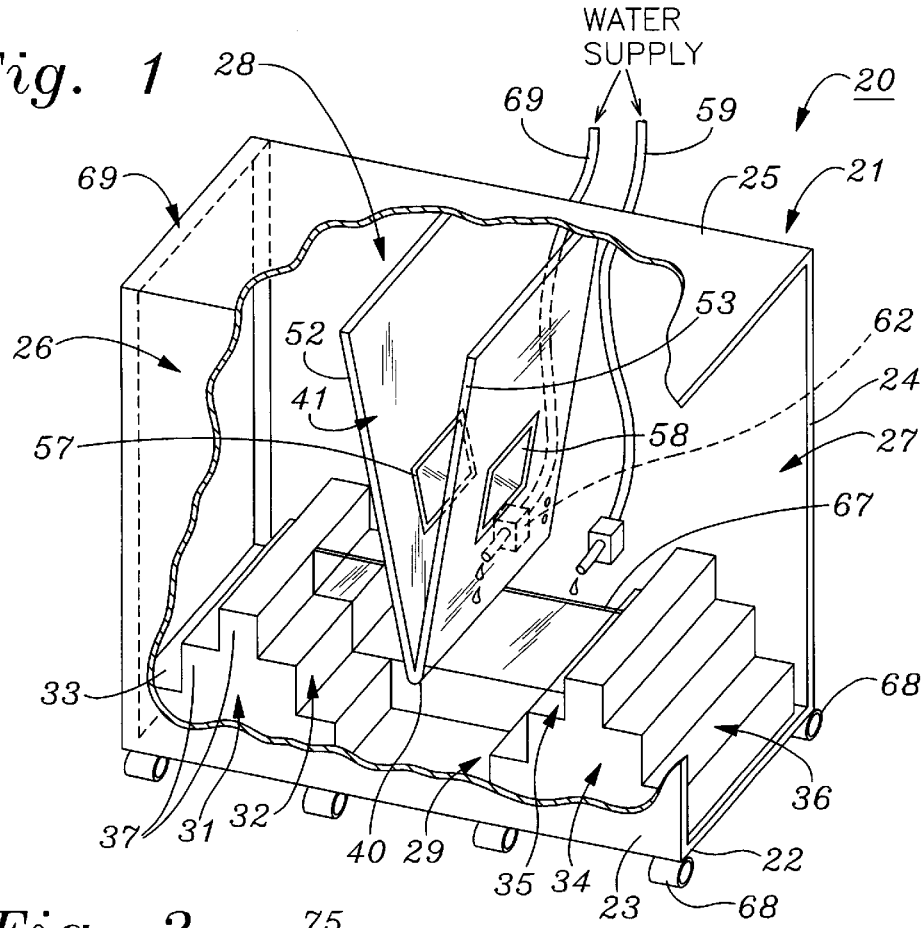
FIG. 1 is a perspective view of a life saving fire exit device according to the present invention.
Figure 2:
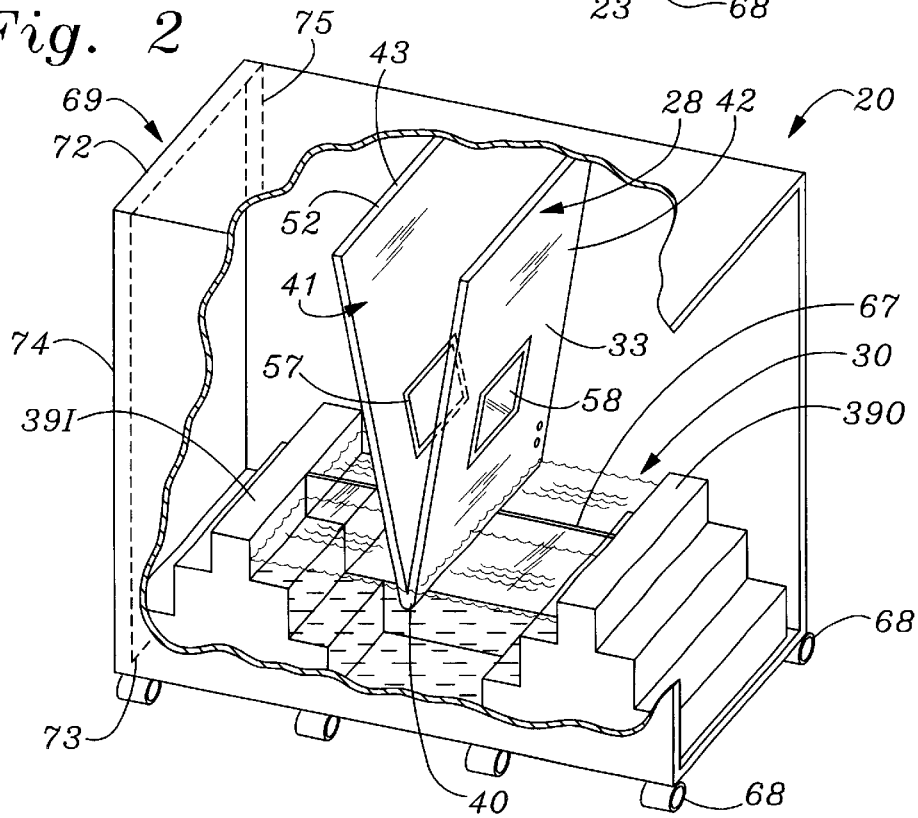
FIG. 2 is a view similar to that of FIG. 1, but showing the device containing water.
Figure 3:
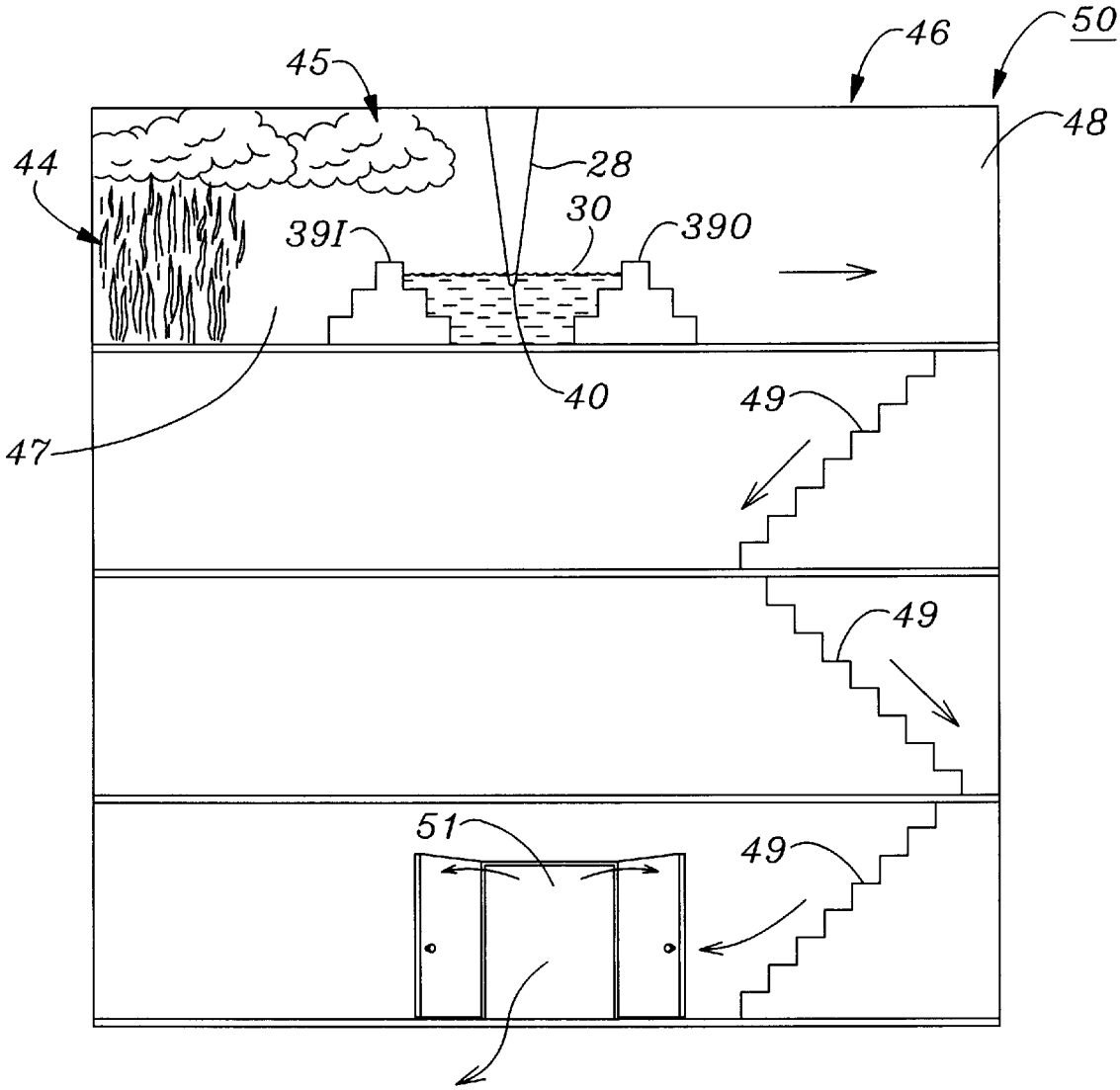
FIG. 3 is a diagrammatic view showing the device of FIG. 1 positioned for use in a building.
Figure 4:
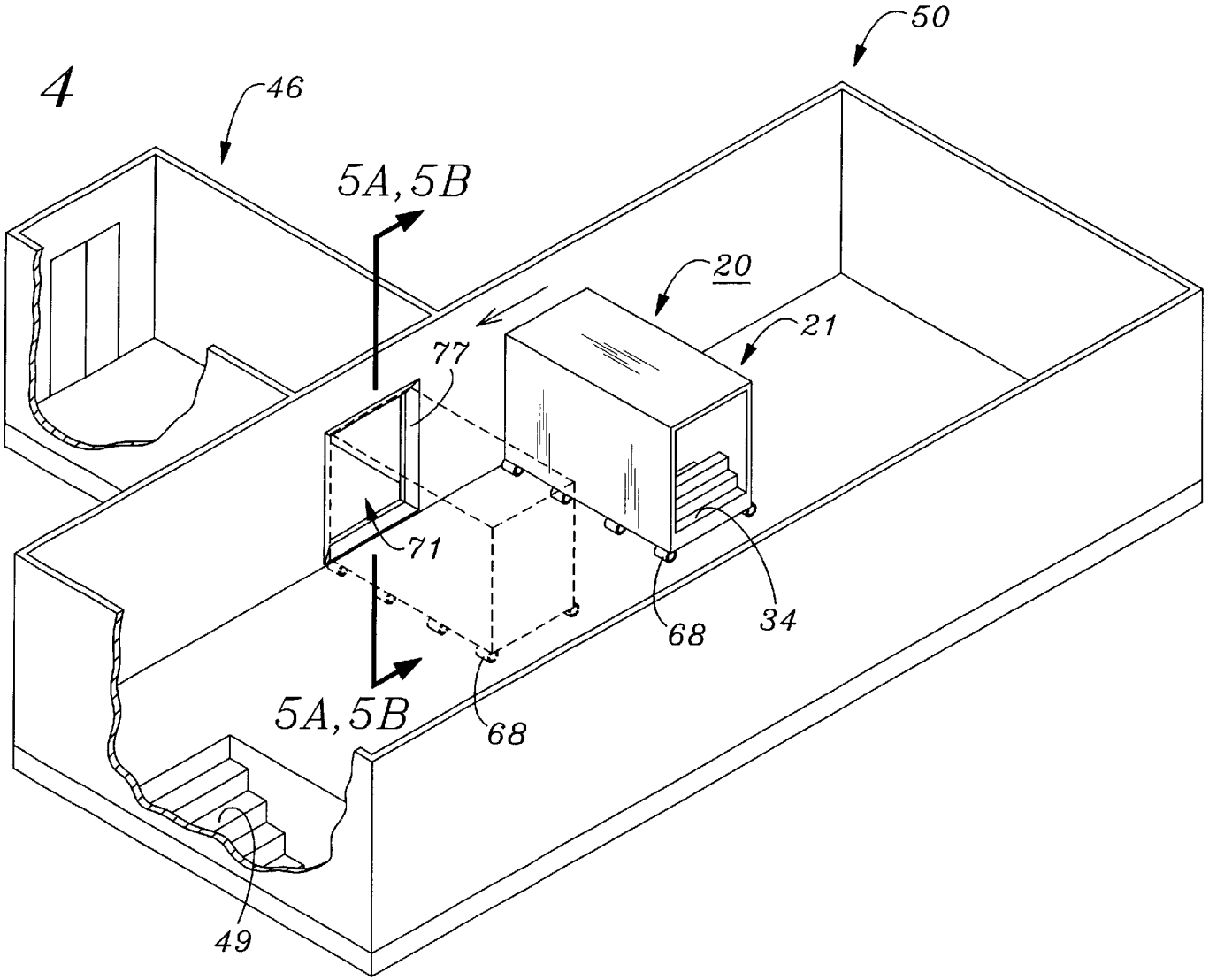
FIG. 4 is a perspective view showing the device of FIG. 1 in a storage position and ready for movement into an operative position in front of a hallway opening in a building.

FIGS. 1 and 2 are perspective, partly schematic views of a basic embodiment of a life saving fire exit apparatus according to the present invention. FIG. 3 is a schematic view showing where the apparatus of FIGS. 1 and 2 is positioned within a building. FIGS. 4 and 5 illustrate details of deploying the apparatus of FIGS. 1 and 2 adjacent to a hallway opening within a building. FIGS. 6–8 illustrate the manner of using the apparatus of FIGS. 1 and 2.

Referring first to FIG. 1, a life saving fire exit apparatus 20 according to the present invention may be seen to include a generally rectangularly-shaped, hollow enclosure 21, which has a longitudinally elongated, rectangularly-shaped base panel 22, upstanding front and rear vertical side panels 23, 24, a roof panel 25 parallel to base panel 22, and left and right vertically disposed rectangularly-shaped entrance and exit openings 26, 27, respectively. Apparatus 20 includes a vertically oriented baffle 28 which is located midway between entrance and exit openings 26, 27, and which is disposed transversely between front and rear wall panels 23, 24 of enclosure 21. As shown in FIG. 1, baffle 28 spans the distance between front and rear wall panels 23, 24, and is joined to those panels, as well as roof panel 25, in airtight junctions therewith.

Referring still to FIGS. 1 and 2, it may be seen that enclosure 21 of fire saving exit apparatus 20 includes above and adjacent to base panel 22 thereof an upwardly concave portion 29, which comprises a tank or reservoir that is adapted to hold a pool of water 30, as shown in FIG. 2. As shown in FIGS. 1 and 2, base panel 22 and front and rear side panels 23, 24 form bottom, front and rear sides, respectively, of tank 29.

The left side of tank 29 is bounded by the longitudinally inwardly located, descending half 32 of a left-hand, entrance up-and-down staircase 31. The latter has a longitudinally outwardly located ascending half 33 shaped symmetrically to descending, inner half 33.

Similarly, the right side of tank 29 is bounded by a longitudinally inwardly located, ascending half 35 of a right-hand, exit up-and-down staircase 34. The latter has a longitudinally outwardly located, descending half 36 shaped symmetrically to ascending inner half 35.

As shown in FIGS. 1 and 2, entrance and exit up-and-down staircases 31, 34 are each comprised of a plurality of fore-and-aft elongated, rectangularly shaped steps 37 which are disposed perpendicularly between front and rear side panels 23, 24 of enclosure 21. Entrance and exit staircases 31, 34 each has an uppermost, middle step 381, 380, respectively, that have upper flat horizontally disposed, co-planar surfaces 391, 390, respectively. As shown in FIG. 2, tank portion 29 of enclosure is filled with water 30 to a level L below surfaces 391, 390, prior to using apparatus 20.

As shown in FIGS. 2 and 3, baffle 28 has a lower edge 40 which is immersed beneath the surface of water 30 in tank 29. Also, baffle 28 has a front side edge 41 which is joined to front side panel 23 of enclosure 21, a rear side edge 42 joined to rear side panel 24, and an upper side edge 43 joined to roof panel 25, in hermetically sealing contact with the respective side panels. With this construction, as shown in FIG. 3, water 30 in tank 29 forms a barrier or water trap which blocks heat, smoke 45, and noxious gases from a fire 44 located to left of entrance opening 26 of enclosure 21 from passing through the barrier to exit opening 27 of the enclosure. As will be described in greater detail below, with enclosure 20 arranged in a building passageway 46 as shown in FIG. 3, individuals in a smoke-filled region 47 of the passageway may transit through tank 29 under baffle 28 to a smoke-free region 48 of the passageway, proceed safely down stairs 49, and out through exit 51 of building 50, as indicated by the series of arrows. As shown in FIG. 3, the exact shape of baffle 28 is not critical, provided that it has upper, front and rear sides which make an air-tight seal with a building passageway while the lower edge wall of the baffle is submerged in water 30 in tank 29 to block smoke, noxious gases and heat from traveling past the baffle.

Preferably, as shown in FIGS. 1-3, baffle 28 has in longitudinal section a V-shape. Baffle 28 is made of a heat resistant material. In a preferred embodiment shown in FIGS. 1 and 2, baffle 28 is made of a longitudinally elongated rectangular sheet of stainless plate which is bent at a transverse center line thereof to form left and right panels 52 and 53 which angle upwardly and outwardly from a lower, vertex edge 40 which is disposed perpendicularly between front and rear side wall panels 23, 24 of enclosure 21. Thus constructed, left and right panels 52 and 53 of baffle 28 form between inner facing surfaces thereof and inner facing surfaces of front and rear panels 23, 24, a V-shaped trough 55 adapted to contain water 56, as shown in FIGS. 2 and 3. Preferably, left and right panels 52, 53 of baffle 28 are fitted with a pair of longitudinally aligned, rectangularly-shaped windows 57, 58, which are made of a visibly transparent, fireproof glass.

As shown in FIG. 1, enclosure 21 of apparatus 20 preferably includes means for automatically filling tank 29 and baffle trough 55 with water, preferably to levels which are approximately the same and at a height of slightly less than one foot below entrance and exit platform surfaces 391, 390. Thus, as shown in FIGS. 1 and 2, apparatus 20 preferably includes one or more water supply pipes or tubes 59, 60, which are connected at inlet ends thereof to a source of water such as a building water supply pipe. Outlet ends of pipes 59, 60 are connected through float valves 61, 62 within tank 29 and trough 55, respectively, the valves opening to admit water into the respective reservoirs, and closing when the water level therein reaches predetermined levels.

As shown in FIGS. 1, 2 and 8, tank 29 of enclosure 21 preferably is partitioned into side-by-side channels of different depths, to facilitate use of the apparatus by both adults and children. Thus, as shown in FIGS. 1 and 8, tank 29 preferably has a deep, adult channel 63 provided with a relatively deep floor panel 64, and a shallow, child's channel 65 which has a shallow floor panel 66. Preferably, deep and shallow channels 63, 65 are separated by a longitudinally disposed vertical separator panel 67 made of a transparent material, e.g., a polycarbonate or acrylic plastic sheet.

Figure 6A:
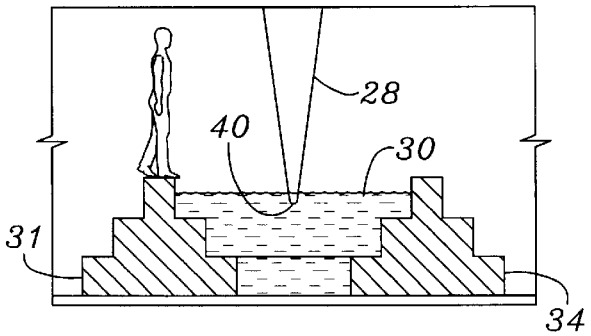
FIGS. 6A through 6C illustrates an adult exiting from a smoke-filled area through the device of FIG. 1.
Figure 7A:
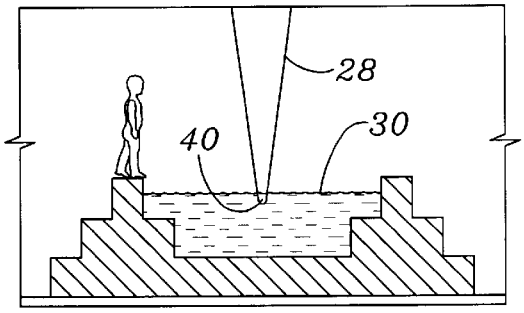
FIGS. 7A through 7C illustrates a child exiting from a smoke-filled area through the device of FIG. 1.
Figure 6B:
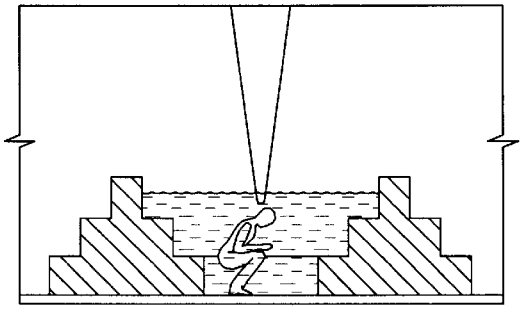
Figure 7B:
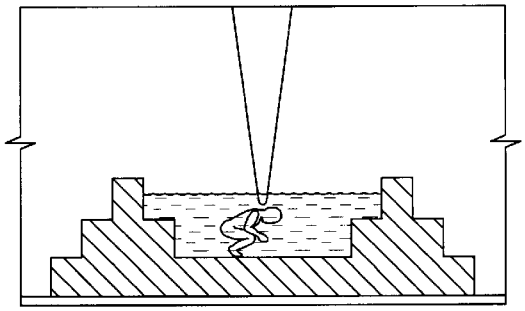
Figure 6C:
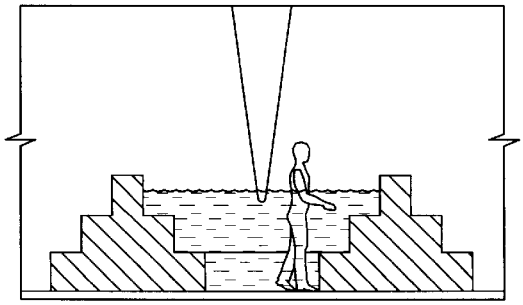
Figure 7C:
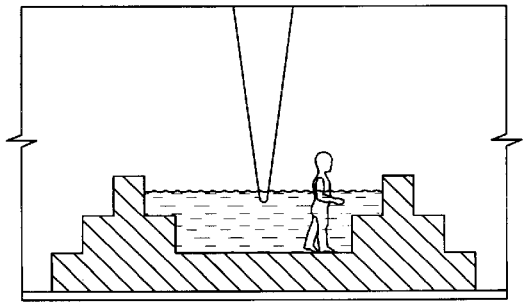

FIGS. 3, 6, and 7 illustrate how adults and children, respectively, may use apparatus 20 to exit from a smoke-filled region to a relatively smoke-free region of a building. Thus, with apparatus 20 installed in hermetically sealing contact with the floors, walls and ceiling of a building passageway 46, as shown in FIG. 3, an adult or child walks up the ascending steps 33 of entrance up/down staircase 31, and pauses on upper surface 391 of uppermost, middle step 38, as shown in FIGS. 6A, 7A. The adult or child then walks down descending portion 32 of entrance staircase 31, into water 30 in tank 29, and stands on the floor panel of the tank. Then, as shown in FIGS. 6B, 7B, the adult or child ducks his head beneath the surface of water 30, sufficiently deep to clear the lower edge wall 40 of baffle 28, and walks forward on the floor panel of the tank towards exit stairway 34. Next, as shown in FIGS. 6C and 7C, the child or adult stands erect, with his or her head above the surface of water 30 in tank 29, walks forward towards exit stairway 34, up the ascending steps 35 and down the descending steps 36 thereof, and walks away from apparatus 20 to exit safely from a smoke-filled region of the building to a relatively smoke-free region, thus facilitating his or her safe exit from the building.

In a preferred embodiment of a life saving fire exit apparatus according to the present invention, the apparatus is so constructed as to be readily movable from a storage position, as shown in solid lines in FIG. 4, to an operable position in hermetically sealing contact with an opening in a building passageway, as shown by dashed lines in FIG. 4. Thus, as shown in FIGS. 1, 2 and 4, apparatus 20 preferably includes a plurality of rollers or casters 68 which rollably support enclosure 21. Also, as may be seen best by referring to FIGS. 4 and 5, apparatus 20 preferably has a peripheral sealing member 69 which enables enclosure 21 to be coupled to an opening 71 of a building passageway in a relatively air-tight seal. As shown in FIGS. 1 and 5, enclosure peripheral sealing member 69 is a rectangular ring-shaped structure which concentrically borders rectangularly-shaped entrance opening 26 of enclosure 21. Sealing member 69 is comprised of upper and lower straight horizontally disposed legs 72, 73, and front and rear vertically disposed straight legs 74, 75. As shown in FIG. 5, each leg of rectangular ring-shaped peripheral sealing member 69 has a right triangular cross-sectional shape, with the hypotenuse of each member angled outwardly from enclosure 21 and towards a longitudinal center line of opening 26; thus sealing member 69 has a beveled outer mating surface 76. As shown in FIG. 5, beveled outer mating surface 76 of enclosure sealing member 69 is confronted by a similarly shaped beveled surface 78 of a passageway peripheral sealing member 77 installed in opening 71 of passageway 70.

Figure 5B:
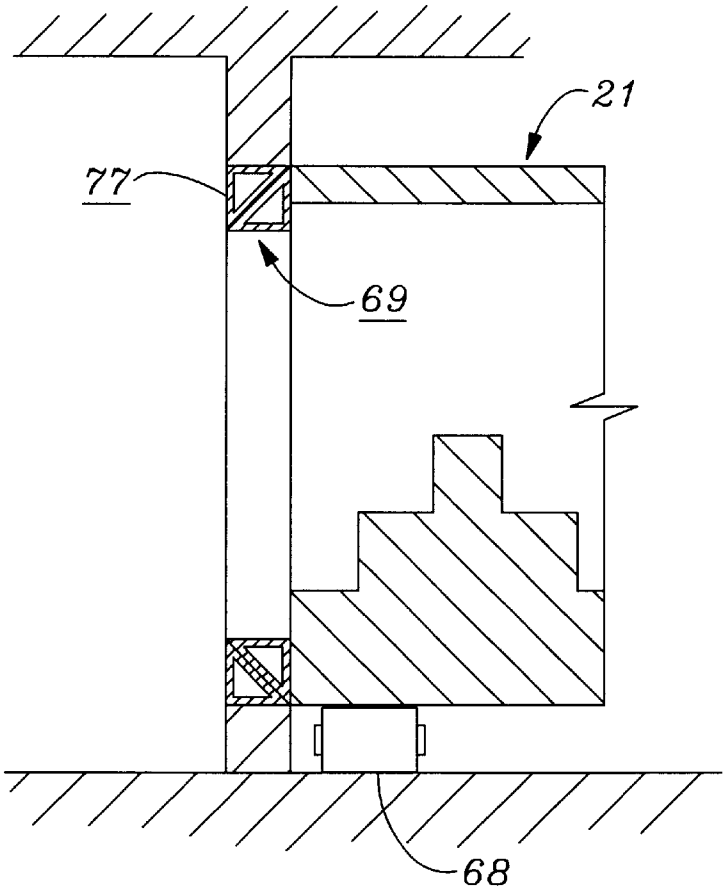
FIG. 5B is a view similar to that of FIG. 5B, showing how the device of FIG. 5A is moved into hermetically sealing contact with a frame installed around the hallway opening, to thereby block smoke, noxious gaseous combustion products, and heat from passing through the opening, while enabling humans to exit from the hallway through the device.
Figure 5A:
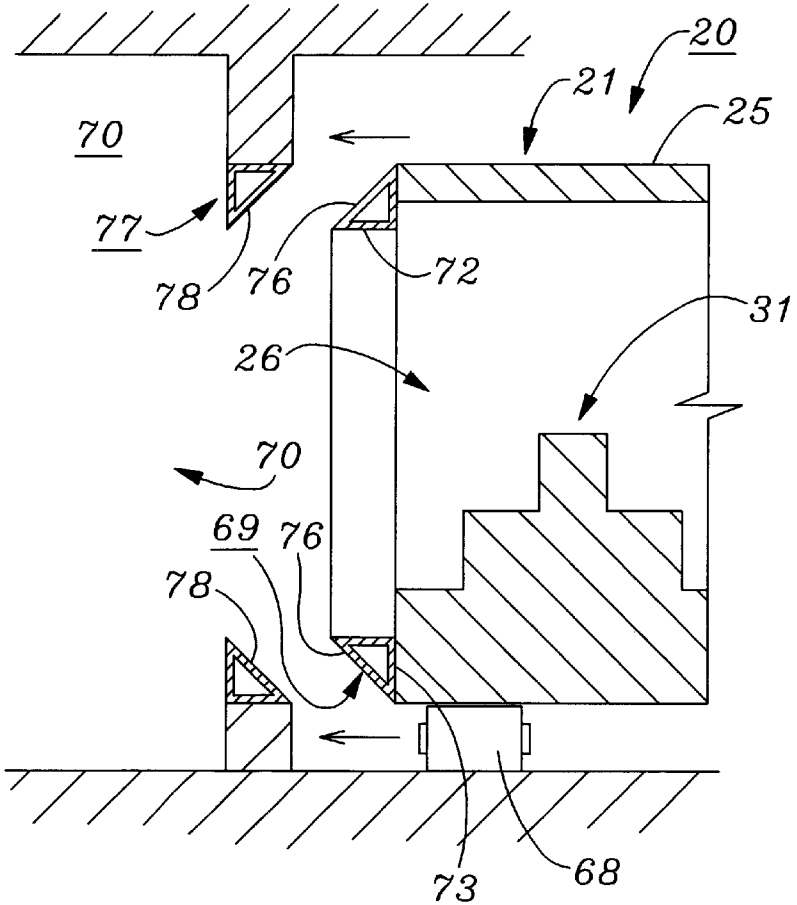
FIG. 5A is a sectional view showing the device of FIG. 4 taken in the direction 5A–5A, and showing the device positioned in front of a hallway opening.

Both enclosure peripheral sealing ring 69 and passageway opening peripheral sealing ring 77 are made of a material which is somewhat flexible and resilient but heat resistant, such as thin gauge stainless steel. Thus, when enclosure 21 of apparatus 20 is moved laterally into position in front of a passageway opening 71, as shown in FIG. 4, and then longitudinally inwardly towards the opening, as shown in FIGS. 5A and 5B, resilient contact of beveled surfaces 76 and 78 of sealing members 69 and 77 form an air-tight, resilient, heat resistant seal.

In a modification of life saving fire exit apparatus 20 described above, solid baffle 28 is replaced partially or entirely by one or more curtains of water dispensed transversely across enclosure 21, and flowing downwardly from manifolds attached to ceiling panel 25 into tank 29. In this modification, a pump is preferably provided to recirculate water from tank 29 to the manifolds. With this arrangement, tank 29 can be substantially shallower, and entrance and exit stairways dispensed with.

The fire life saving fire exit apparatus and methods according to the present invention may also be used advantageously by fire fighters as a portal for entering as well as leaving smoke-filled regions of a building.

FIGS. 9 and 10 illustrate a modification of a life saving fire exit apparatus according to the present invention, which is suitable for use by a person in a wheel chair.

As shown in FIGS. 9 and 10, modified life saving fire exit device 120 includes a generally rectangularly-shaped, open-top tank 129 which has a rectangularly-shaped base panel 122, front and rear vertical side panels 123, 124, and left and right vertical end panels 126, 127, respectively. As in the basic embodiment 20, apparatus 120 includes an enclosure (not shown) and a hollow, V-shaped baffle 122 which protrudes downwardly from a roof panel (not shown) of the enclosure, the baffle having a lower edge 140 which is immersed below the surface of water 130 contained in tank 129. Apparatus 120 also includes a rectangularly-shaped platform 131 which is supported by a plurality of vertically disposed linear actuator cylinders 132 which protrude upwardly from the upper surface of base panel 122. Actuator cylinders 132 are energizable by a hydraulic or pneumatic pressure source (not shown) to alternately raise platform 131, as shown in FIG. 10, or lower it, as shown in FIG. 9.

Apparatus 120 also includes a mechanism for raising a wheelchair 133 occupied by a person 134 from a building floor 135 on which tank 129 resides to a height above that of the upper edges 136, 137 of end panels 126, 127, lowering the wheelchair into water 130, raising wheelchair 134 above upper edge 137 of right-hand end panel 137 of tank 129, after it has transited underneath baffle 128, and lowering the wheelchair back to floor level. One such mechanism for performing the aforementioned actions comprises a pair of external platforms raised and lowered by linear actuator cylinders, similar in structure and function to platform 131 and cylinders 132 described above. In this implementation, one such external platform is located adjacent to the outside of left-hand tank end panel 126, while the other exterior platform is located adjacent to the outside of right-hand tank panel 127.

Figure 11:
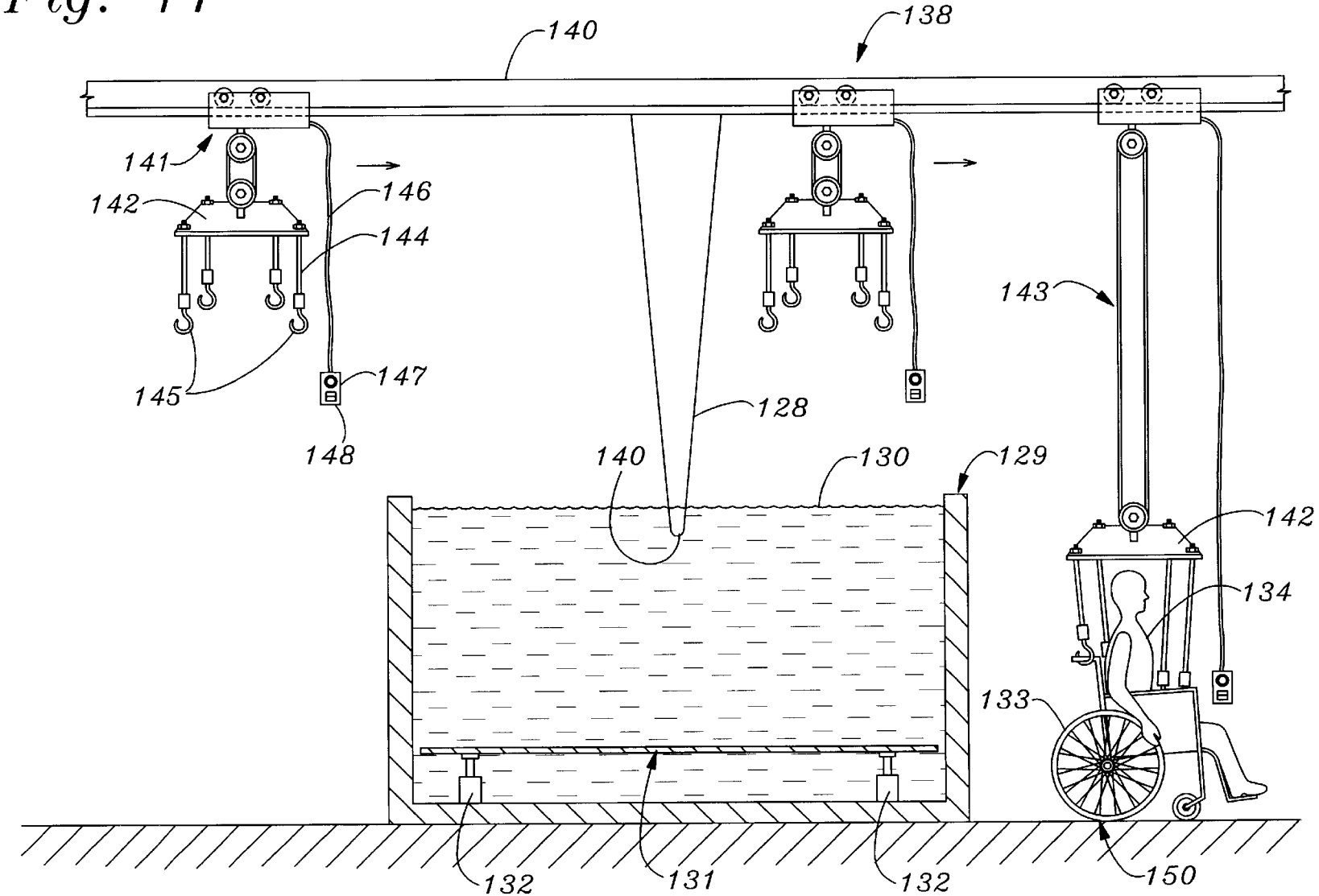
FIG. 11 is a diagrammatic view of another modification of the device of FIG. 1 suitable for use by a person in a wheel chair.

FIG. 11 illustrates an alternate mechanism 138 for facilitating movement of a wheelchair 133 and occupant 134 through tank 129. Mechanism 138 includes a longitudinally disposed trolley track 140 which rollably supports a trolley 141, the track being positioned above and parallel to a longitudinal center line of tank 129. A platform 142 is suspended from trolley 141 by a variable length, motor-driven cable and pulley mechanism 143. Flexible elastic cords 144 are in turn suspended from the corners of platform 142, each cord having at the lower end thereof a hook 144 adapted to engage a structural member of wheelchair 133. Mechanism 138 includes a flexible multi-conductor electrical cable 145 which is suspended from trolley 141, and in turn suspends at the lower end of the cable an electrical control box 147. Control box 147 contains controls 148 which are used to operate a trolley drive motor (not shown) and an elevator motor (not shown) for operating cable lift mechanism 143. To use mechanism 138 a person 134 in wheelchair 133 first engages structural members of the wheelchair with hooks 145, with trolley 141 located on the left-hand side of left end panel 126 of tank 129. Next, person 134 operates controls 148 on control box 147 to energize lifting mechanism 143, thereby elevating the lower edges of the wheelchair wheels 150 above edge 1136 of end panel 126. Controls 148 of control box 147 are then actuated to cause trolley 141 to move longitudinally to a location between left end panel 126 and baffle 128, and lower the wheelchair into tank 129 onto platform 131, whereupon platform 131 is lowered, and trolley 141 then used to translate the wheelchair horizontally beneath lower edge 140 of baffle 128, as shown in FIG. 9. Platform 131 is again raised, enabling person 134 to operate controls 148 of control box 147 to cause trolley 141 to translate the wheelchair to the right of right-hand end panel 129, and to cause lift mechanism 143 to lower the wheelchair to floor level 150. Hooks 145 are then disengaged from the wheelchair, allowing the wheelchair and occupant to safely exit the building.

As described above, methods and apparatus according to the present invention function as a barrier which inhibits heat, smoke and noxious combustion gases produced by a fire located upstream of a hallway opening or doorway in a building from diffusing into areas of the building downstream from the hallway opening, the barrier being so arranged as to enable people to quickly and safely travel through the barrier to safely exit the building. According to the invention, the barrier is not breached by a person transiting through the barrier, thus continuing to function effectively in blocking heat, smoke and noxious combustion products from traveling through the barrier with the person. The described functions are accomplished by forming an air lock in hermetically sealing contact with a hallway opening. The air lock consists of a pool of water and a vertically disposed baffle which has a lower edge that protrudes vertically downwards from a location near a hallway ceiling to a location beneath the surface of water in a pool. The baffle is disposed transversely to a longitudinal exit path through the apparatus, and sufficient clearance is provided between the lower edge of the baffle and the bottom of the pool to enable individuals to duck under the baffle edge and walk under the pool. In one embodiment, the baffle consists of a solid structure, while in another embodiment, the "baffle" consists of one or more continuously flowing curtains of water which pour downwardly into a shallow pool. In both embodiments, the apparatus is arranged to be in reasonably good hermetically sealing contact with a building hallway. However, those skilled in the art will recognize that the present invention may be advantageously utilized even if the hermetic sealing is not perfect, allowing relatively small volumes of combustion products to leak by the apparatus. The exact degree of sealing perfection is chosen according to cost/benefit trade-offs performed as part of a conventional engineering analysis. Thus, in the following claims, hermetically sealed or sealed is to be logically interpreted as substantially sealed, the exact degree of which sealing is a matter of ordinary engineering design choice.

What is claimed is:

1. An apparatus for inhibiting combustion products from a fire from diffusing through a passageway in a structure while enabling an individual to pass through said passageway, said apparatus comprising;

a. a open-top water tank for containing water, b. air-lock means hermetically sealable to said passageway and water in said tank, and c. passage means enabling an individual to pass through said air-lock means from a first, entrance side on said apparatus adjacent to a first region of a structure which contains combustion products, to a second, exit side of said apparatus adjacent to a second region of said structure from which said combustion products are substantially blocked by said air-lock means.

2. The apparatus of claim 1 wherein said air-lock means comprises in combination;

a. an enclosure which at least partially encloses said water tank, said enclosure having a roof panel located above said water tank, an entrance opening, and an exit opening, b. means for hermetically sealing said entrance opening to an opening of said passageway, and c. baffle means protruding downwardly from said roof panel, said baffle means having upper and side edges in hermetically sealing contact with said passageway, and a lower edge immersed in said water in said tank.

3. The apparatus of claim 2 wherein said baffle means is further defined as being a solid structure.

4. The apparatus of claim 3 wherein said passage means enabling an individual to pass through said air-lock means is further defined as being a space between said lower edge wall of said baffle and a bottom panel of said tank, said space being filled with water and of sufficient size for an individual to walk on said bottom panel under said lower baffle.

5. The apparatus of claim 4 further including entrance staircase means located at said entrance opening of said enclosure having up steps staggered upwardly from an entrance side of said apparatus to a height at least that of an entrance edge of said tank, and down steps staggered downwardly into said tank.

6. The apparatus of claim 5 further including exit staircase means located at said exit opening of said enclosure and having up steps staggered upwardly from the interior of said tank to a height at least that of an exit edge of said tank, and down steps staggered downwardly from said tank.

7. The apparatus of claim 2 wherein said baffle means is further defined as including at least a first panel disposed transversely between front and rear side walls of said enclosure, said panel being located longitudinally between said entrance and exit side openings of said enclosure, and vertically above said water tank.

8. The apparatus of claim 7 wherein said baffle means is further defined as including a second panel longitudinally spaced apart from said first panel, said first and second panels being joined at lower transverse ends thereof.

9. The apparatus of claim 8 wherein said first and second panels form therebetween a hollow interior space.

10. The apparatus of claim 9 wherein said hollow interior space is adapted to hold a quantity of water.

11. The apparatus of claim 9 wherein said first and second panels are further defined as being provided with a pair of longitudinally spaced apart and aligned, optically transparent windows.

12. The apparatus of claim 2 wherein said baffle means is further defined as including at least a first water curtain disposed transversely between front and rear side walls of said enclosure, said water curtain being located longitudinally between said entrance and exit side openings of said enclosure, and comprising a generally slab-shaped column of water which flows downwardly from manifold means located proximate said roof panel of said enclosure into said tank.

13. The apparatus of claim 12 further including outlet discharge means for maintaining a water level in said tank below a predetermined maximum level.

14. The apparatus of claim 13 wherein said outlet discharge means comprises a pump which circulates water between said tank and said manifold means.

15. An apparatus for inhibiting products from a fire from diffusing through a building passageway while enabling an individual to pass through said passageway, said apparatus comprising;

a. an enclosure having an entrance opening and an exit opening, b. means for hermetically sealing said entrance opening to a building passageway opening, c. an open-top water tank located within said enclosure between said entrance and exit openings thereof, d. a generally vertical baffle disposed transversely with respect to a line longitudinally disposed between said entrance and exit openings, said baffle having a lower edge immersed in water in said tank and upper, rear and side edges which cooperate with said lower edge in forming an air-lock between said entrance and exit sides of said baffle, and e. passage means for enabling an individual to enter said entrance opening of said apparatus, move longitudinally past said baffle, and exit through said exit opening of said apparatus.

16. The apparatus of claim 15 further including means for introducing water into said tank and maintaining a water level in said tank at a predetermined minimum level higher than that of said lower edge of said baffle.

17. The apparatus of claim 15 wherein said water tank is further defined as having a generally flat, horizontally disposed bottom wall.

18. The apparatus of claim 17 wherein said water tank is further defined as having upright front and rear side walls.

19. The apparatus of claim 18 wherein said water tank is further defined as having a first upright, entrance side wall proximate said entrance opening of said enclosure, and a second upright, exit side wall proximate said exit opening of said enclosure.

20. The apparatus of claim 19 wherein said baffle is further defined as including at least a first panel disposed transversely between front and rear side walls of said enclosure, said panel being located longitudinally between said entrance and exit side openings of said enclosure, and vertically above said water tank.

21. The apparatus of claim 20 wherein said baffle means is further defined as including a second panel longitudinally spaced apart from said first panel, said first and second panels being joined at lower transverse ends thereof.

22. The apparatus of claim 21 wherein said first and second panels form therebetween a V-shaped hollow interior space.

23. The apparatus of claim 22 further including means for introducing water into said V-shaped hollow interior space between said first and second baffle panels and maintaining a water level in said space at a predetermined minimum level.

24. The apparatus of claim 22 wherein said first and second panels are further defined as being provided with a pair of longitudinally spaced apart and aligned, optically transparent windows.

25. The apparatus of claim 20 wherein said tank is further being partitioned into at least two longitudinally disposed side-by-side channels of two different depths suitable for adults and children respectively.

26. The apparatus of claim 25 wherein said children's channel includes a longitudinally disposed shallow floor panel located above and parallel to said bottom wall of said tank.

27. The apparatus of claim 26 wherein said tank is further defined as including a longitudinally disposed, vertical separator panel between said first and second channels.

28. The apparatus of claim 20 wherein said tank is further defined as including a platform supported above and parallel to said bottom wall of said tank, and remotely operable actuator means for raising and lowering said platform relative to said bottom wall of said tank, to thereby facilitate receiving a wheelchair occupied by a person on said platform.

29. The apparatus of claim 28 further including means for hoisting said occupied wheelchair above said entrance side wall of said tank and onto said platform, and above said exit side wall of said tank and off of said platform.

30. The apparatus of claim 15 wherein said baffle means is further defined as including at least a first water curtain disposed transversely between front and rear side walls of said enclosure, said water curtain being located longitudinally between said entrance and exit side openings of said enclosure, and comprising a generally slab-shaped column of water which flows downwardly from manifold means located proximate said roof panel of said enclosure into said tank.

31. The apparatus of claim 30 further including outlet discharge means for maintaining a water level in said tank below a predetermined maximum level.

32. The apparatus of claim 31 wherein said outlet discharge means comprises a pump which circulates water between said tank and said manifold means.

33. A method for inhibiting wide dispersal of smoke, noxious gases and heat emanating from a fire in a building, and facilitating safe-evacuation of people from the building comprising;

a. positioning a pool of water within a passageway in a building, b. positioning a baffle in hermetically sealing contact with side walls and ceiling of said passageway, said baffle being disposed vertically downwardly from said ceiling with a lower edge of said baffle immersed beneath the surface of water in said pool, and c. providing an access path through said pool, said access path enabling an individual to step into the pool, duck his or her head into the water beneath said lower edge of said baffle, walk through the water underneath said baffle, and step out of said pool to a relatively smoke-free evacuation route from said building.

* * * * *